United States Patent [19]

Greven

[11] 4,182,150

[45] Jan. 8, 1980

[54] CARRIAGE DRAWING MACHINE FOR UNIFORMLY DRAWING AND LONGITUDINALLY SEVERING ELONGATED MATERIAL TO BE DRAWN

[75] Inventor: Johann Greven, Aachen, Fed. Rep. of Germany

[73] Assignee: Schumag Schumacher Metallwerke, Aachen, Fed. Rep. of Germany

[21] Appl. No.: 828,901

[22] Filed: Aug. 29, 1977

[30] Foreign Application Priority Data

Aug. 27, 1976 [DE] Fed. Rep. of Germany ..... 2638628

[51] Int. Cl.[2] ..... B21C 1/28

[52] U.S. Cl. ..... 72/290; 226/166

[58] Field of Search ..... 72/275, 287, 290, 291, 72/301, 302, 305, 307, 293; 24/263 SW, 263 R; 269/85, 104, 154, 217, 218, 234, 259, 270, 279, 280; 226/160, 165, 166

[56] References Cited

U.S. PATENT DOCUMENTS

| | | | |
|---|---|---|---|
| 2,646,708 | 7/1953 | Nickas, Jr. | 269/279 |
| 3,247,565 | 4/1966 | Griffin | 24/263 SW |
| 3,416,350 | 12/1968 | Eagleson et al. | 72/293 |
| 3,690,133 | 9/1972 | Hilgers | 72/290 |
| 3,844,152 | 10/1974 | Peytavin | 72/287 |

FOREIGN PATENT DOCUMENTS

| | | | |
|---|---|---|---|
| 471525 | 2/1951 | Canada | 72/290 |
| 593437 | 2/1934 | Fed. Rep. of Germany | 72/290 |
| 2009915 | 9/1970 | Fed. Rep. of Germany | 72/290 |

*Primary Examiner*—Lowell A. Larson
*Attorney, Agent, or Firm*—Herbert L. Lerner

[57] ABSTRACT

In a carriage drawing machine for uniformly drawing and longitudinally severing elongated material to be drawn, having two drawing carriages on a carriage bed, a drive shaft disposed parallel to the carriage bed and having two cams revolvable therewith for effecting reciprocating motion of the carriages in mutually opposite directions, a drawing jaw vise on each carriage for alternatingly gripping the material to be drawn, each of the vises having two drawing jaws held in a housing by a wedge structure with bearing rollers interposed which serves to self-lock during the drawing, and an after-connected severing device which is advanceable each time the drawn material is severed, the improvement wherein the two drawing jaws of each vise are disposed on top of one another and, within clamping travel distance, the lower one of the drawing jaws is movable parallel to the direction of drawing and the upper one of the drawing jaws is movable parallel to the wedge structure of the housing.

2 Claims, 7 Drawing Figures

CARRIAGE DRAWING MACHINE FOR UNIFORMLY DRAWING AND LONGITUDINALLY SEVERING ELONGATED MATERIAL TO BE DRAWN

The invention relates to a carriage drawing machine for uniformly drawing and cutting to length elongated material to be drawn, having two drawing carriages on a carriage bed, a drive shaft disposed parallel to the carriage bed and having two cams revolvable therewith for effecting reciprocating movement of the carriages, a drawing jaw vise each on each carriage for alternatingly gripping the material to be drawn, each of the vises having two drawing jaws held in a housing by a wedge structure with bearing rollers interposed which serves to self-lock during the drawing, and an after-connected severing device which is advanceable each time the drawn material is severed.

Such a machine has become known heretofore from the German Patent DT-PS No. 593,437. In this heretofore known machine, the drawing jaws are located adjacent one another in a horizontal plane and clamp the material to be drawn, which is located therebetween from the sides and thus transmit the drawing force to the material to be drawn. This heretofore known construction has proven to be practical for drawing round stock. When drawing flat stock, however, disadvantages have arisen. Flat stock can be gripped only edgewise by the drawing jaws. Since the elevational position of the drawing jaws cannot be changed, flat stock with a large side ratio protrudes upwardly beyond the drawing jaws, or the drawing jaws engage only the lower part of the cross section thereto. Due to this off-center engagement or contact, a bending moment is exerted upon the material to be drawn, so tat the material to be drawn becomes curved. A further disadvantage is that the material to be drawn, which runs through edgewise, must be supported on the transport guide track thereof not only from below but also from the sides so that it does not buckle. This makes the transport guide track quite expensive.

It is therefore an object of the invention to provide a carriage drawing machine of the aforementioned general type which avoids the foregoing disadvantages and which affords the drawing of round stock, sectional or profiled stock, flat stock and the like without difficulty.

With the foregoing and other objects in view, there is provided in accordance with the invention, in a carriage drawing machine for uniformly drawing and longitudinally severing elongated material to be drawn, having two drawing carriages on a carriage bed, a drive shaft disposed parallel to the carriage bed and havig two cams revolvable therewith for effecting reciprocating motion of the carriages in mutually opposite directions, a drawing jaw vise on each carriage for alternatingly gripping the material to be drawn, each of the vises having two drawing jaws held in a housing by a wedge structure with bearing rollers interposed which serves to self-lock during the drawing and an after-connected severing device which is advanceable each time the drawn material is severed, the improvement wherein the two drawing jaws of each vise are disposed on top of one another and, within clamping travel distance, the lower one of the drawing jaws is movable parallel to the direction of drawing and the upper one of the drawing jaws is movable parallel to the wedge structure of the housing.

Because the two drawing jaws are disposed above one another, it is possible that flat stock with horizontal orientation can run through the machine. The drawing jaws can then engage the material to be drawn always in the center of the cross section thereof. Thus, no bending moments which could cause curvature, act on the material to be drawn. In width, advantageously, much space is available between the drawing jaws for the material to be drawn. Tests have shown that, with the drawing machine according to the invention, flat stock can be worked wherein the ratio of the sides (width to thickness) is about 25:1 and even more. The horizontal orientation of the material to be drawn also permits a more simplified construction of the transport guide track. The material to be drawn needs to be supported only from below, and lateral supports can be eliminated without danger of buckling.

Overall, the material to be drawn is continuously drawn in a rectilinear direction, while being stretched straight simultaneously and no longer bent. The material to be drawn therefore presents particularly favorable conditions for straightening in an after-connected straightener, for example, a roller straightener. Such a straightener works all the better, the more uniform the material fed to it. After passing the straightener, the material runs through a cutting device which is moved along each time therewith during the severing operation and severs the passing material into the predetermined bar lengths without stopping the material. In this manner, especially economical production is provided which, in the case of the drawing machine according to the invention, is of especially great accuracy.

In accordance with another feature of the invention, the lower drawing jaw is flat and is mounted at a bottom location of the carriage.

In accordance with a further feature of the invention, the upper drawing jaw is accommodatable to the profile shape of the material to be drawn.

In accordance with an added feature of the invention, the upper drawing jaw has a flat lower surface which, for drawing flat stock, is parallel to the upper surface of the lower drawing jaw and for drawing trapezoidal profiles (commutator profiles), the upper drawing jaw with the flat lower surface thereof, is rotatable about an axis parallel to the direction of drawing and can thus be accommodated to the angle of the trapezoidal profile.

In accordance with a concomitant feature of the invention, the upper drawing jaw has an exchangeable holding element formed with surfaces and slots for accommodating to flat round and polygonal stock.

Other features which are considered as characteristic for the invention are set forth in the appended claims.

Although the invention is illustrated and described herein as embodied in a carriage drawing machine for uniformly drawing and longitudinally severing elongated material to be drawn, it is nevertheless not intended to be limited to the details shown, since various modifications and structural chages may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
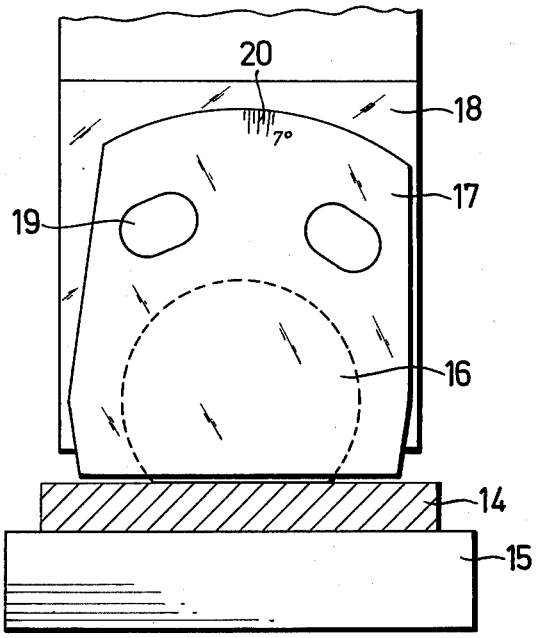
FIG. 4 is an enlarged fragmentary diagrammatic view of FIG. 3 but as seen from the opposite side of the lower flat drawing jaw and the upper rotatable drawing ja in a position for accommodating flat stock.
Figure 5:
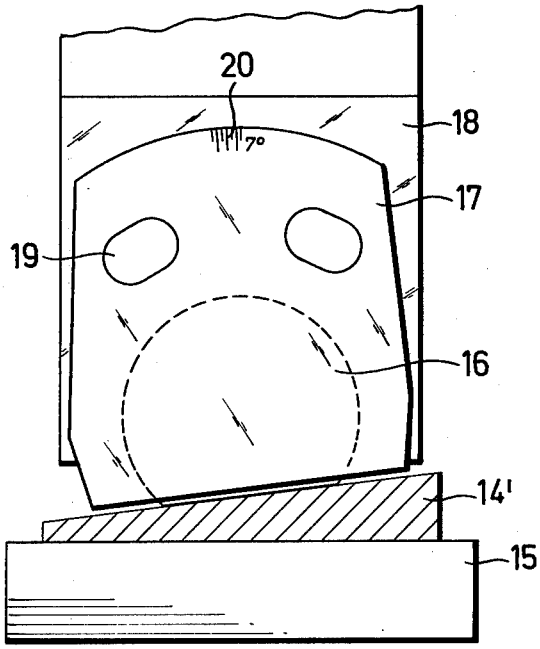
Figure 6:
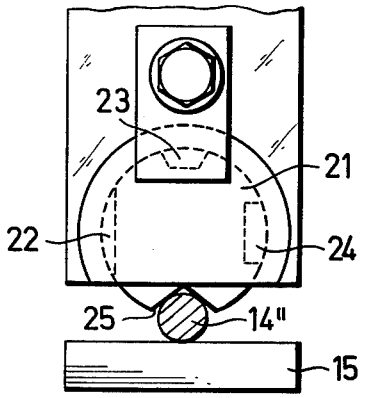
Figure 7:
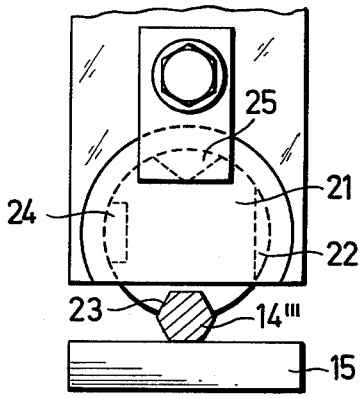

FIG. 5 is another view of FIG. 4, however, showing the upper drawing jaw in a position wherein it accommodates stock having a trapezoidal profile; and FIGS. 6 and 7 are reduced views of another embodiment of FIGS. 4 and 5 having an upper drawing jaw which is accomodatable by rotation thereof to stock of varying profiles cross sections and, specifically, in FIG. 6, accommodated to round stock and in FIG. 7, to hexagonal material.

Figure 1:
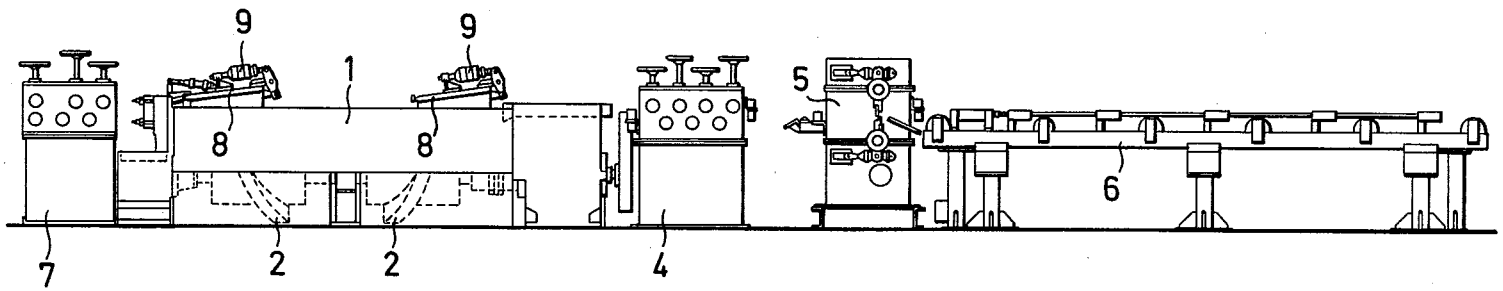
FIG. 1 is a front elevational view of the entire drawing machine according to the invention including associated auxiliary devices.
Figure 3:
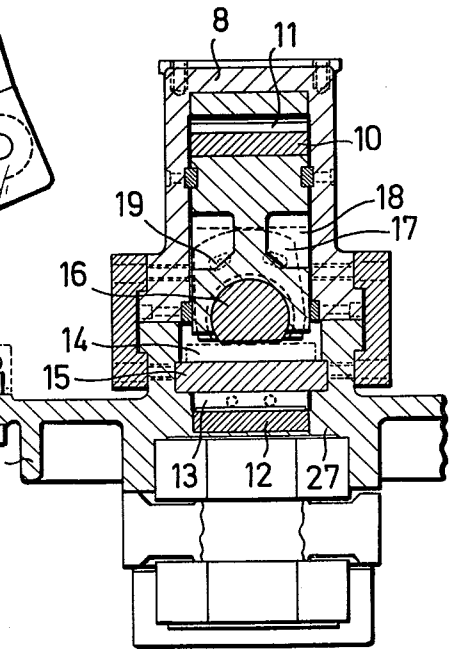
FIG. 3 is a cross-sectional view of FIG. 1 taken along the line III—III in the direction of the arrows.
Figure 2:
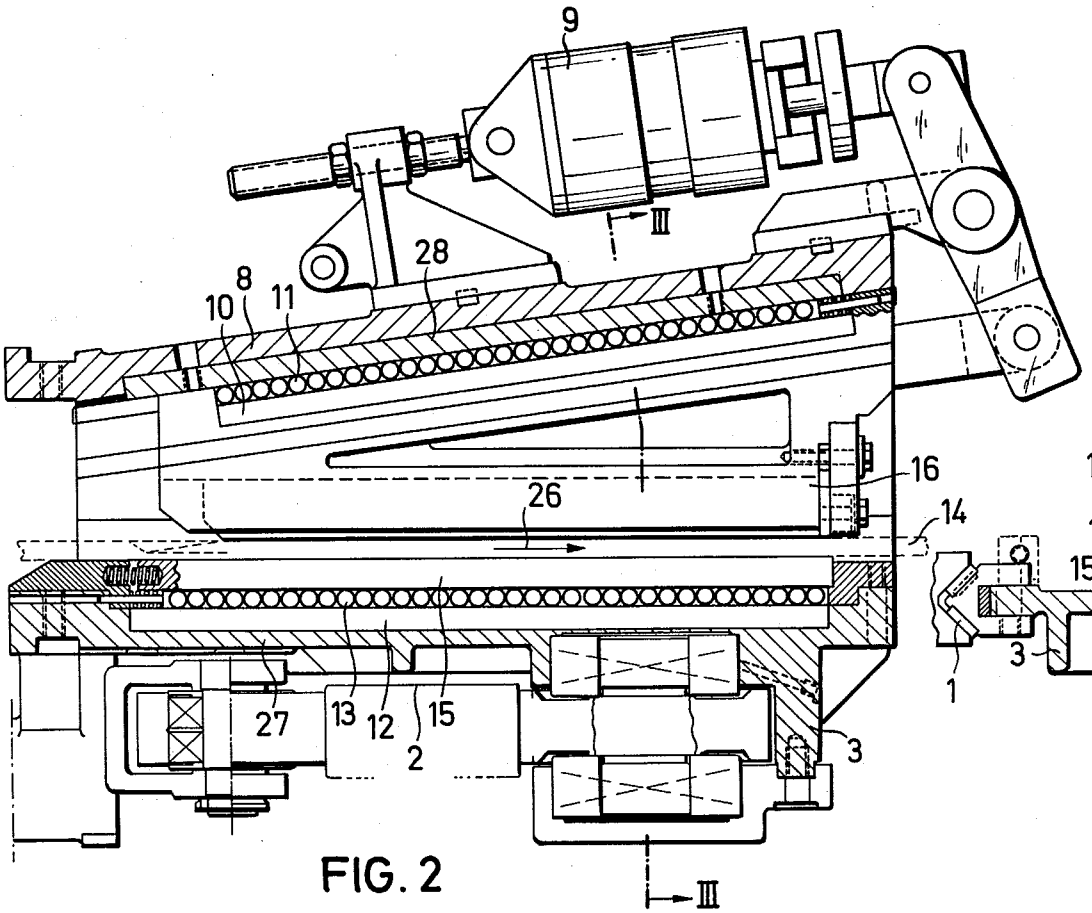
FIG. 2 is an enlarged fragmentary, partly sectional view of FIG. 1 showing the drawing jaws thereof disposed on top of one another in a wedge-shaped housing.

Referring now to the drawing and first, particularly, to FIG. 1 thereof, there is shown a carriage bed or track 1 and revolving cams 2 which serve to produce reciprocating movement of carriages 3.The carriages 3 respectively, carry a drawing jaw vise having an upper housing wall 8. For initiating the movement thereof, the drawing jaw vises each have a control cylinder 9 (note also FIGS. 2 and 3). The material 14 to be drawn is assumed, in FIGS. 1 to 3, to be flat stock and is assumed to advance in the drawing direction represented by the arrow 26. It passes, at first, through a roller straightener 7, then the hereinaforedescribed drawing section and then another roller straightener 4. Thereafter, it runs through a cutting section 5, which cuts the material to length when the desired length has run onto the transport guide track 6.

The drawing vise housing has a lower wall 27 which smultaneously, serves as the base of the carriage 3. This base is parallel to the drawing direction indicated by the arrow 26. The upper wall 8 of the drawing-jaw or drawing-vise housing is inclined wedge-like to the direction of drawing represented by the arrow 26. Roller tracks 12 and 28 with rollers 13 and 11 are, respectively, connected to the walls 27 and 8. On the rollers 13, the lower, flat drawing jaw 15 has a slight mobility or displaceability in the drawing direction arrow 26 or opposite thereto. On the rollers 11, the upper drawing jaw 16 has a given mobility or displaceability over the travel surface 10, parallel to the wedge wall 8. The upper drawing jaw 16 is constructed to be rotatable (not also FIGS. 4 and 5). On the lower side thereof, the upper drawing jaw 16 has a flat surface, which is parallel to the upper surface of the lower drawing jaw 15 when flat stock 14 is drawn. If trapezoidal material 14' (commutator material) is drawn, the lower surface of the drawing jaw 16 is inclined. The inclination is effected by the holding member 17, which cooperates with screws in elongated holes or slots 19. The inclination can be set at the scale 20. The holding member 17 is pivotally mounted on a holder 18.

The drawing jaws 15 and 16, after being released by the cylinder 9, are self-locking during the drawing because of the wedge inclination of the wedge wall 8.

FIGS. 6 and 7 show a somewhat different embodiment of the upper drawing jaw than that of FIGS. 4 and 5. This drawing jaw 21 is rotatable and has a surface 22 for flat stock 14, a cutout 23 for hexagonal material 14''', a cutout 24 for rectangular material and a cutout 25 for round stock 14''. The lower drawing jaw 15 can always be flat in such an embodiment.

The round stock 14'' is gripped at three contact lines: along one line by the lower drawing jaw 15 and along two lines within the V-slot 25 of the upper drawing jaw 21. The line contact should be of such great length in this case, that the high contact pressure of the drawing jaws 15 and 16 does not deform or flatten the draw material 14'' at the contact lines during the drawing. If the contact lines are long enough, the specific contact pressure can be kept so low that such deformation will not occur.

The upper drawing jaw 16 or the holding member 17, respectively, can also operate without tightening the screws in the slots or elongated holes 19. Because of the then remaining rotatability of the drawing jaw 16, automatic accommodation to the drawing profile 14 or 14' is thus provided during the drawing. The same applies to the rotatability of the upper drawing jaw 21.

I claim:

1. In a carriage drawing machine for uniformly drawing elongated material to be drawn, having two drawing carriages on a carriage bed, a drive shaft disposed parallel to the carriage bed and having two cams revolvable therewith for effecting reciprocating motion of the carriages in mutually opposite directions, a drawing jaw vise on each carriage for alternatingly gripping the material to be drawn, each of the vises having two drawing jaws held in a housing by a wedge structure with bearing rollers interposed which serves to self-lock during the drawing, the improvement wherein the two drawing jaws of each vise are disposed on top of one another and, within clamping travel distance, the lower one of said drawing jaws is movable parallel to the direction of drawing and the upper one of said drawing jaws is movable parallel to the wedge structure of the housing, said upper drawing jaw having a flat lower surface and being rotatable about an axis parallel to the drawing direction for accommodating to flat and trapezoidal profiles of the material to be drawn.

2. Carriage drawing machine according to claim 1 including means for releasably fixing said upper drawing jaw against rotation about said axis parallel to the drawing direction.

* * * * *